United States Patent [19]

Falgout, Sr. et al.

[11] Patent Number: 4,807,709

[45] Date of Patent: Feb. 28, 1989

[54] FLUID POWERED DRILLING JAR

[75] Inventors: Thomas E. Falgout, Sr., Youngsville; William N. Schoeffler, Lafayette, both of La.

[73] Assignee: Pioneer Fishing and Rental Tools, Inc., Youngsville, La.

[21] Appl. No.: 915,660

[22] Filed: Oct. 6, 1986

[51] Int. Cl.[4] ..... E21B 1/00; E21B 31/113

[52] U.S. Cl. ..... 175/296; 166/178

[58] Field of Search ..... 175/293, 296, 297; 166/178, 320

[56] References Cited

U.S. PATENT DOCUMENTS

| | | | |
|---|---|---|---|
| 3,361,220 | 1/1968 | Brown | 175/296 |
| 3,379,261 | 4/1968 | Martini | 175/296 |
| 3,491,838 | 1/1970 | Wilder et al. | 175/296 |
| 3,570,611 | 3/1971 | Riziuc et al. | 175/296 |
| 3,735,827 | 5/1973 | Berryman | 175/296 |
| 4,200,158 | 4/1980 | Perkins | 175/2[illegible] |
| 4,478,284 | 10/1984 | Tomm et al. | 175/297 |
| 4,655,289 | 4/1987 | Schoeffler | 166/320 |

FOREIGN PATENT DOCUMENTS

| | | | |
|---|---|---|---|
| 0933924 | 6/1982 | U.S.S.R. | 175/296 |

*Primary Examiner*—Stephen J. Novosad
*Assistant Examiner*—William P. Neuder
*Attorney, Agent, or Firm*—John D. Jeter

[57] ABSTRACT

A hydraulic drill string jar is powered and actuated by drilling fluid pressure controlled from the earth surface. By selective manipulation of drilling fluid flow, the jar can be conditioned to operate in drilling mode to avoid activation of the jars while normal drilling and fluid flow activities take place. By different fluid flow manipulations, the jar is conditioned to operate in the jarring mode. In the jarring mode, the jars will axially shock the drill string each time the flow rate is reduced below a preselected amount and then increased to a higher preselected amount.

20 Claims, 2 Drawing Sheets

FLUID POWERED DRILLING JAR

This invention pertains to well drilling with fluid conducting drill strings including drill string jars. More particularly, this invention pertains to drill string jars powered by the drilling fluid to impart shock loads to the drill string to free stuck pipe and the like.

In the preferred embodiment, apparatus of this invention incorporates, as a sub-assembly, the Remote Controlled Selector Valve of the copending U.S. Pat. No. 4,655,289 issued 04/07/87. That patent, by reference, is made part of this specification.

BACKGROUND OF THE INVENTION

Drill string jars conventionally used, and all known to be in current use, rely upon axial force applied to the drill string for power and actuation. Usually, rotation of the drill string, to some extent, is used to trigger the jars under stress. In some cases, the drill string is only triggered by reverse rotational force applied to the stressed drill string. With jars used near the bottom of the drill string, lifting force, in excess of the force normally required to lift the lower drill string assembly can trigger the jars. Quite often, it is undesirable to axially move the drill string to reset and activate the jars.

The following U.S. patents may be regarded as typical of tension and compression jars in common use in oil field service. These jars derive jarring power from drill string stress by allowing the tool bodies to telescope a limited amount. U.S. Pat. Nos. 2,008,743 issued July 23, 1935; 2,065,135 issued Dec. 22, 1936; 2,144,869 issued Jan. 24, 1939; 2,819,877 issued Jan. 14, 1958; 2,978,048 issued April 4, 1961; and 4,376,468 issued Mar. 15, 1983 are typical.

There are several reasons to avoid axial manipulations of the drill string jars, other than applying the essential axial loads needed to assist in the loosening action, for stuck strings, accomplished by shock loads of jars.

With a stuck drill string, axial drill string loads managable from the earth surface, often do not reach below the stuck point. Jars dependent upon drill string manipulation may not actuate below the stuck point. There is a need for jars that can operate at the first convenient assembly point above the drill head, or anywhere along the drill string.

The usual long drill string provides a powerful hydraulic circuit that is commonly still active, through the full length, during stuck string situations. In addition to being powerful, the drill string is capacitive and can store considerable fluid energy if pressure is built up before fluid power is admitted to the jars.

It is therefore an object of this invention to provide drill string jars powered by drilling fluid pressure in the drill string to impart axial shock loads to the drill string when selective manipulation of the drilling fluid flow controls are exercised at the earth surface.

It is another object of this invention to provide drill string jars powered by drilling fluid pressure to activate and reset for subsequent activation independently of axial loads or rotational manipulations of the drill string.

It is yet another object of this invention to provide a drilling fluid powered and activated drill string jar that permits normal drilling and drilling fluid flow without activating the jars.

It is still a further object of this invention to provide a drilling fluid powered drill string jar that will actuate only after a preselected fluid pressure is established in the drill string.

It is yet a further object of this invention to provide drilling fluid powered and pressure activated jars that can be arranged to jar upward or downward on the drill string.

These and other objects, advantages, and features of this invention will be apparent to those skilled in the art from a consideration of this specification including the attached drawings and appended claims.

SUMMARY OF THE INVENTION

A drill string jar with a heavy piston to act as a jarring mass is powered by drilling fluid pressure arranged to propel the mass against stops on the jar body to jar the drill string. A remote control selector valve responds to drilling fluid flow manipulations of a first characteristic to shift the jar into drilling mode during which normal drilling and flow activities can be carried out without jarring the string. Drilling fluid flow manipulations of a second characteristic shifts the jar to the jarring mode. The drill string will be jarred each time the drilling fluid flow is reduced, then increased, within selected limits.

A heavy piston is situated in an axially directed opening in the jar and driven by drilling fluid pressure against stops in the distal end of the opening. A relief valve delays fluid flow from the drill string to the piston until fluid pressure energy is built up in the drill string. The relief, or pilot, valve opens rapidly to direct drilling fluid to the piston and acts more slowly to open a bypass for drilling fluid to flow to the downwardly continuing drill string.

The jar machine elements can be arranged to direct jarring action upward or downward. Additionally, the relief valve can be arranged to activate the jar at preselected drill string pressures, permitting the use of a series of jars in the drill string assembly.

In all three drawings, manufacturing and maintenance utility features such as fasteners and threaded connections that do not pertain to points of novelty are omitted in the interest of clarity. Some resilient seals commonly used to reduce fit precision requirements are not shown.

Figure 1A:
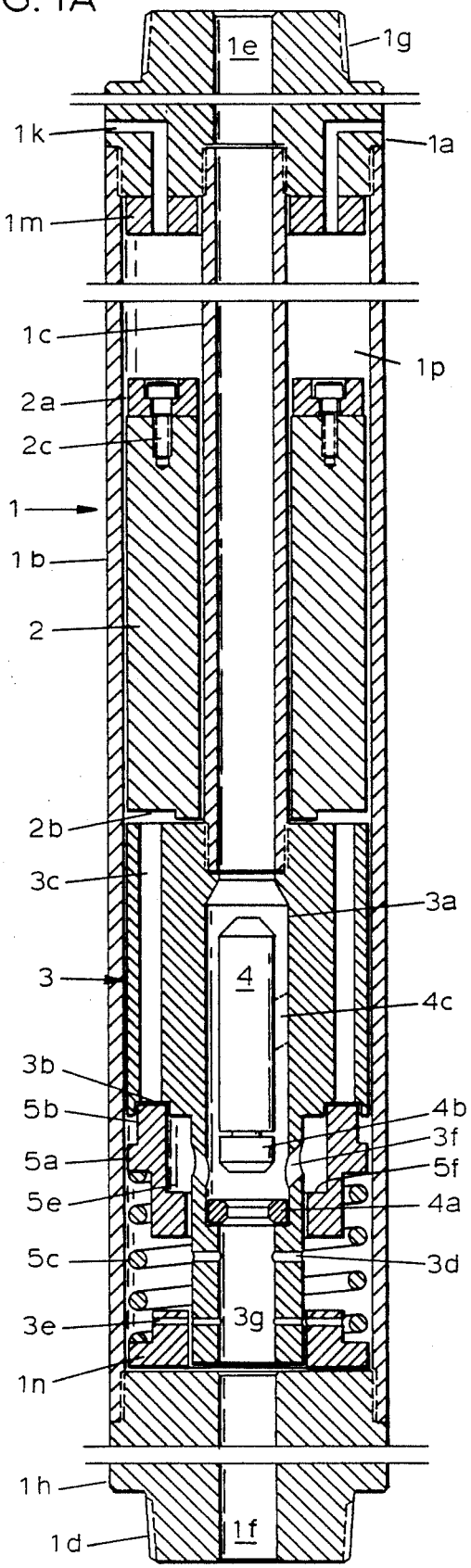
FIG. 1A is a side view, in cutaway, of the preferred embodiment of the present invention.
Figure 1B:
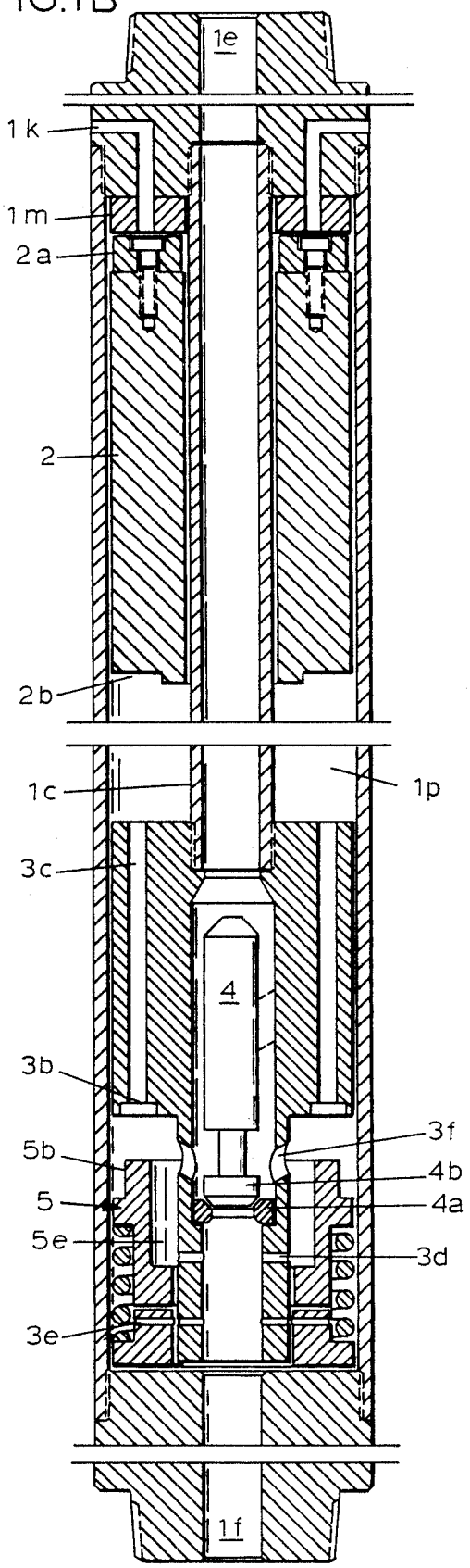
FIG. 1B is identical to FIG. 1A but shown after the apparatus has been actuated to jar a drill string.
Figure 2:
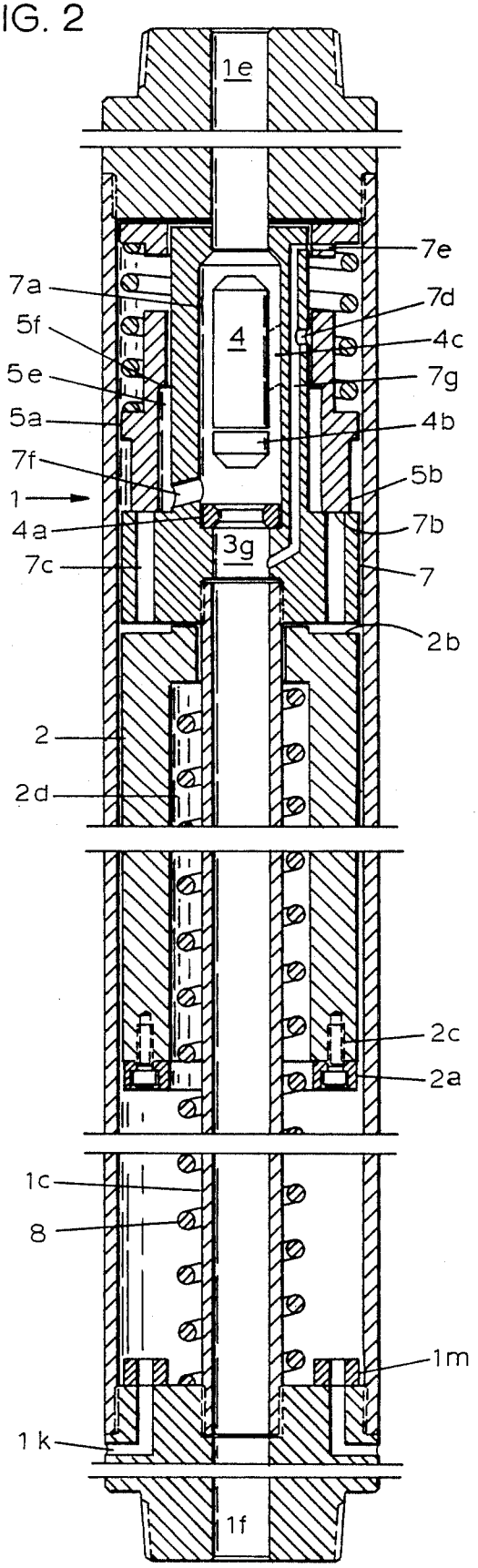
FIG. 2 is a side view, in cutaway, of an apparatus functionally similar to the apparatus of FIG. 1A but oriented to deliver jarring shock in the opposite direction relative to the drill string.

FIG. 2 has many functionally identical elements compared with FIGS. 1A and 1B and such elements are similarly captioned although minor configuration differences may exist.

DETAILED DESCRIPTION OF DRAWINGS

FIG. 1A is a side view of the preferred embodiment of this invention. Body 1 serves as a length of drill string. Upper terminal 1*a* has a tool joint connection 1*g* for fluid tight attachment to an upwardly continuing drill string. The drilling fluid flowing down the drill string continues down bore 1*e* into the body. The upper terminal is threadedly connected to the outer body tube 1*b*. The outer body tube is, in turn, threadedly connected to lower body terminal 1*h*. The lower terminal has bore 1*f* to conduct drilling fluid from the body to a downwardly continuing drill string. The lower terminal has tool joint 1*d* to connect the body with fluid tightness to the drill string. A wash pipe 1*c* is threadedly connected for fluid tightness to the upper terminal and is a continuation of bore 1*e*. The wash pipe is threadedly connected, fluid tight, to valve locator 3. Valve locator 3 continues downward to the upper end of the lower body terminal 1*h*. Locator 3 has opening 3*a* to accomodate and position remote control selector valve 4 and permit fluid flow around the valve. Orifice 4*a* is secured in the lower end of opening 3*a* and fluid flowing through the washpipe goes through the orifice when poppet 4*b* is above the orifice. Poppet 4*b*, part of the control selector valve, In the annular opening 1*p* between the body tube bore and the washpipe, mass piston 2 is situated for limited axial movement therein. The mass piston is heavy and gravity biased toward the first, or lower, end of opening 1*p*.

If added biase is needed, a spring such as spring 8 of FIG. 2 can be added around washpipe 1*c* between abutting element 1*m* and mass piston 2. In FIG. 2 the mass piston is shown to have an annular opening to protect and allow spring length clearance.

Pilot valve 5 has annular poppet 5*b* situated to occlude the annular orifice 3*b*. The annular orifice controls fluid communication from ports 3*f*, which open into opening 3*a*, to the mass piston face 2*b* through channels 3*c*. Channels 3*c* are distributed about, and extend generally parallel the body centerline.

Pilot valve 5 includes bias spring 5*c* which is situated to urge the annular valve piston 5*a* upward to occlude orifice 3*b*, with poppet 5*b*.

The pilot valve piston 5*a* has a pilot by-pass clearance 5*e* down which fluid can flow. When pressure at ports 3*f* exceed a preselected amount, the pressure acting on the piston face 5*f* will urge the pilot valve downward, overcoming spring 5*c* to open orifice 3*b*. The area of poppet 5*b*, once the poppet moves, becomes an added piston area and the pilot valve then moves rapidly downward. When the pilot valve moves near the lower stroke limit, piston face 5*f* uncovers by-pass channel 3*d* and fluid can flow from ports 3*f* through channel 3*d* and to the central bore 3*g* and downward to the continuing drill string. Considerable fluid pressure energy builds up in the upwardly continuing drill string before the pilot valve moves. When the pilot valve starts motion, then opens rapidly, fluid is admitted to the mass piston face 2*b* and the mass moves rapidly upward. During upward movement of the mass, fluid is displaced from the upper end of the opening through vent channels 1*k* to the well annulus.

Abutting element 1*m* is removably attached to the top terminal by cap screws (not shown) and has holes forming a continuation of vent channels 1*k*. Mass piston 2 has removable abutting element 2*a* fastened by cap screws 2*c*. When the abutting elements contact, the mass is suddenly stopped, delivering a shock blow to the body and hence the drill string.

When the abutting elements are in contact the vent holes and channels are closed. Fluid under pressure can by-pass the cylindrical surfaces of the mass and stopping vent flow avoids consequent erosion.

FIG. 1A shows the drill string before the jarring activity is initiated. The normal drilling activity may be carried out with full drilling fluid flow. The remote control selector valve is open and drilling fluid flows from the upwardly continuing drill string through bore 1*e*, through the bore of the washpipe 1*c*, through opening 3*a*, through orifice 4*a*, down bore 1*f* and into the downwardly continuing drill string. This fluid route comprises a first communication means.

A second fluid communication means includes inlet 1*e*, the bore of washpipe 1*c*, opening 3*a*, ports 3*f*, channels 3*c*, and the lower, or first, end of the annular opening between the bore of body tube 1*b* and washpipe 1*c*.

A third communication means includes inlet 1*e*, the bore of washpipe 1*c*, opening 3*a*, ports 3*f*, pilot by-pass clearance 5*e*, port 3*d*, bore 3*g* and outlet 1*f*.

Ideally, mass piston 2 will have completed an impact excursion before by-pass channel 3*d* opens. Pilot valve vent ports 3*e* are sized to delay the rate of movement of the pilot valve 5. This delay means is adjustable by selection of the sizes of holes 3*e* in replaceable transition block 1*n*.

The remote control selector valve has retained the poppet 4*b* above orifice 4*a*, has disabled the jar, for normal drilling, and selector valve 4 has functioned as a disabler means. The pilot valve annular piston will not move downward under the influence of normal drilling fluid flow with the poppet 4*b* open.

FIG. 1B shows the apparatus of FIG. 1A after drilling fluid pressure manipulations have placed the remote control selector valve 4 in the jarring mode. Poppet 4*b* has moved down to occlude the orifice 4*a*. Before pilot valve 5 moved down to the position shown, the downward movement was slowed by restriction of vent 3*e* so that mass piston 2 reached the upper limit of movement, and delivered a jarring action before the pilot piston surface 5*f* opened channel 3*d*.

When channel 3*d* opened, fluid could flow through the jar and to the downwardly continuing drill string. To re-activate the jarring action repeatedly, fluid flow can be reduced enough to allow the pilot valve to move up to close orifice 3*b*. Some fluid flow will be maintained so that poppet 4*b* will not move up to reset the remote control selector valve from jarring mode when fluid flow is again increased. With the system still in the jarring mode, but the orifice 3*b* closed, the mass piston will move down by gravity force while fluid in opening 1*p* by-passes the piston by way of radial clearances.

When the mass piston is at the upper, or second, end of opening 1*p*, element 2*a* closes the channels to vent ports 1*k*.

The remote control selector valve preferred for control of apparatus of this invention is responsive to fluid flow. When used in a drill string assembly, fluid flow is produced by pressure applied at the earth surface. The jarring mechanism is actuated by fluid pressure and powered by fluid volume under pressure. When viewed at the earth surface where fluid flow manipulations are controlled, fluid flow is proportional to pressure, and flow resistance inherent in the down hole apparatus of this invention will also appear as added pressure. From the earth surface, fluid flow and fluid pressure can be expressed interchangably and no ambiguity exists.

Apparatus of this invention is classified as a drilling jar in deference to oil field practice but drilling jars are commonly used on pipe strings for other purposes, such as fishing and workover. The drilling jar definition should not be viewed in a limiting sense.

FIG. 2 represents an apparatus functionally identical to the apparatus of FIG. 1A, but oriented to deliver a jarring impact downward instead of upward.

The principal change is the addition of spring 8 to bias the mass piston upward to overcome the force of gravity. To accomodate the spring in minimum structure, bore 2*d* has been added to the mass piston.

Valve locator 7 differs in configuration to allow channel 7*g* to fluidly communicate the low pressure end of the pilot valve 5, by way of ports 7*e*, to bore 3*g*, downstream of the orifice 4*a*. When the pilot valve 5 opens, by-pass port 7*d* is similarly in communication with bore 3*g*.

The first fluid communication means includes inlet 1*e*, opening 7*a*, bore 3*g*, the bore of washpipe 1*c* and outlet 1*f*. The second fluid communication means now includes inlet 1*e*, opening 7*a*, port 7*f*, channels 7*c* and the first end of the mass piston opening. The third fluid communication means now includes inlet 1*e*,. opening 7*a*, port 7*f*, pilot by-pass clearance 5*e*, by-pass channel 7*d*, channel 7*g*, bore 38, the bore of wash pipe 1*c* and outlet 1*f*.

The positions of the various elements, once actuated, have been described in detail relative to FIG. 1B and are not repeated for FIG. 2.

In FIG. 2, the mass piston 2 has to be lifted back to the starting position after a hammer blow and spring 8 is provided to drive the piston upward.

By manipulation of the drilling fluid flow controls, at the earth surface, the remote control selector valve 4 can be actuated to put the jar into action The preferred characteristics of fluid flow manipulation to activate the jar involves effectively stopping drilling fluid flow and restarting fluid flow. By preference, the remote control selector valve will change from one mode to the other each time the drilling fluid flow is effectively stopped and restarted. By selection of closing bias force, the pilot valve can be caused to function at a fluid flow rate higher than the low flow rate required to activate the control valve. To repeatedly jar the drill string, then drilling fluid flow can be decreased, while the selector valve is in the jarring mode, until the pilot valve allows the mass to return to the first end of the opening, then increasing fluid flow until the pilot valve opens to drive the mass against the abutting surfaces to jar the string. The axial strain can be held on the drill string as jarring repeatedly takes place.

If drilling fluid flow drops low enough to cause the selector valve to change mode, the pressure visible on surface pressure indicators will reveal the change. A decrease, followed by an increase, in fluid flow rate will cause the selector valve to again change mode back to the preferred status. The fluid flow can again be increased to exercise the preferred mode.

The mass piston may be regarded as a hammer and limited movement in the opening implies means to stop the movement of the mass, or hammer. The hammer stopping means can be defined as an anvil and attached, as is the opening, to the body.

It is practical to use a plurality of jars of this invention, in series, in one drill string assembly. Each jar can be assembled to actuate at a drilling fluid pressure independently of other jars. As drilling fluid pressure is increased, they will actuate, or trigger, in succession while in the mode for jarring. All jars in one drill string assembly will have to be in the same mode, drilling or jarring, when sent downhole. All jars will then change mode at the same time and retain synchronization.

In addition to serial assembly of jars in the drill string, jars can be mixed in terms of upward and downward jarring direction. Additionally, jars of this invention can be actuated below stuck points not subject to axial manipulation of the drill string. A series of jarring actions both above and below the stuck point, if above the bit, applied in both up and down directions can be expected to yield the best possible combination to loosen stuck strings.

From the foregoing,.it will be seen that this invention is one well adapted to attain all of the ends and objects hereinabove set forth, together with other advantages which are obvious and which are inherent to the method and apparatus It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, we claim:

1. A drilling fluid powered drill string jar comprising:

(a) a body comprising a length of drill string;

(b) an elongated generally cylindrical opening situated in said body, having a first end and a second end and having an axial centerline generally parallel the centerline of said body;

(c) a mass situated for limited axial movement in said opening and operatively associated with said opening to act as a piston therein;

(d) a first fluid communication means to conduct drilling fluid from an upwardly continuing drill string through said body to a downwardly continuing drill string;

(e) a second fluid communication means to conduct drilling fluid from the upstream end of said first fluid communication means to said first end of said opening;

(f) selector valve means, situated in said body, operatively associated with said first and said second fluid communication means, to close said first fluid communication means and open said second fluid communication means in response to drilling fluid flow rate greater than a preselected limit fluid flow rate greater than a preselected limit and to function as a disabler means responsive to a preselected number of instances of drilling fluid flow rate changes, between said preselected limit to disable said jar; and (g) motion stop means comprising abutting surfaces on said mass and on said body situated to stop axial movement of said mass when said mass reaches the limit of said axial movement at said second end of said opening.

2. The apparatus of claim 1 wherein said mass is biased toward said first end of said opening.

3. The apparatus of claim 1 wherein said second end of said elongated cylindrical opening is in fluid communication with a vent communication means opening to the well annulus.

4. The apparatus of claim 1 further providing that said selector valve means is operatively associated with said first communication means arranged to inhibit flow through said first fluid communication means downstream of said second fluid communication means.

5. The apparatus of claim 1 further providing a relief valve responsive to pressure differential across said selector valve means, operatively associated with said second fluid communication means to open said second fluid communication pressure across said valve means is exceeded.

6. The apparatus of claim 5 further providing that said relief valve open said second fluid communication means to a third fluid communication means by-passing said selector valve means when fluid pressure in said second communication means exceeds a preselected amount.

7. The apparatus of claim 1 further providing limited fluid flow by-pass means from the first end of said opening to the second end of said opening.

8. The apparatus of claim 3 further providing that said opposed abutting surfaces be operatively associated with said vent communication means to close said vent communication means when said mass is at said second end of said opening.

9. The apparatus of claim 1 further providing that said elongated generally cylindrical opening in said body be bounded by an inner washpipe and an outer body tube.

10. The apparatus of claim 1 further providing that said abutting surface on said mass be on a replaceable element secured to said mass.

11. The apparatus of claim 1 further providing that said abutting surface in said opening be on a replaceable element secured to said body.

12. The apparatus of claim 5 further providing that said relief valve actuate at a higher drilling fluid pressure than the minimum drilling fluid pressure required to actuate said selector valve means.

13. The apparatus of claim 5 further providing that fluid displaced by movement of said relief valve be vented through a flow rate restrictor means into said first fluid communication means downstream of said selector valve means.

14. The apparatus of claim 1 wherein said first end of said elongated generally cylindrical opening is on the downstream end of said elongated generally cylindrical opening relative to the flow of drilling fluid through said body.

15. The apparatus of claim 1 wherein said first end of said elongated generally cylindrical opening is on the upstream end of said elongated generally cylindrical opening relative to the flow of drilling fluid through said body.

16. The apparatus of claim 1 further providing bias means to urge said mass toward said first end of said opening.

17. A drill string jar comprising:

an elongated generally cylindrical body capable of functioning as a length of drill pipe, with means at each end to attach with fluid tight engagement to a drill string;

an opening in said body extending in a direction generally parallel the longitudinal axis of said body;

a mass situated for limited axial motion in said opening and arranged to function as a piston in said opening;

a first fluid communication means to conduct drilling fluid from an upwardly continuing drill string, attached to said body, to a downwardly continuing drill string, attached to said body;

a second fluid communication means to conduct drilling fluid from an upwardly continuing drill string, attached to said body, to a first end of said opening;

a remote controlled selector valve means operatively associated with said two communication means, responsive to drilling fluid pressure manipulations of a first characteristic to close said first communication means and to open said second communication means and responsive to fluid pressure manipulations of a second characteristic to open said first communication means and to close said second communication means; and means situated in said body to bias said mass toward said first end of said opening.

18. The apparatus of claim 1 further providing a relief valve means to resist the flow of drilling fluid to said first end of said opening until drilling fluid pressure exceeds a preselected amount.

19. The apparatus of claim 1 further providing a by-pass valve means operatively associated with the drilling fluid circuit to said first end of said opening to permit drilling fluid flow to the downwardly continuing drill string when said mass is at the second end of said opening.

20. The apparatus of claim 1 further providing a relief valve means in the fluid circuit to said first end of said generally cylindrical opening to admit drilling fluid to said first end of said generally cylindrical opening after the drilling fluid pressure in said first fluid communication means exceeds a preselected amount.

* * * * *